US006484990B1

(12) United States Patent
Marshall

(10) Patent No.: US 6,484,990 B1
(45) Date of Patent: Nov. 26, 2002

(54) TARGET CLAMP

(75) Inventor: Thomas Marshall, Springville, UT (US)

(73) Assignee: Action Target, Provo, UT (US)

( * ) Notice: Subject to any disclaimer, the term of this patent is extended or adjusted under 35 U.S.C. 154(b) by 37 days.

(21) Appl. No.: 09/636,156

(22) Filed: Aug. 10, 2000

(51) Int. Cl.[7] ..... F41J 1/10
(52) U.S. Cl. ..... 248/316.1; 273/407; 248/316.6
(58) Field of Search ..... 273/407; 248/316.4, 248/316.1, 316.2, 316.3, 316.6, 316.7, 316.8; 24/67.3, 67.5, 67.7; 473/476

(56) References Cited

U.S. PATENT DOCUMENTS 4,084,299 A * 4/1978 Noda ..... 24/489
4,228,569 A * 10/1980 Snyder ..... 24/489
4,506,416 A * 3/1985 Ohminato et al. ..... 24/489
5,621,950 A * 4/1997 White ..... 24/565
5,950,283 A * 9/1999 Sato ..... 24/67 R

OTHER PUBLICATIONS

DuelAtron Catalogue (1995).
The Porta Target Catalogue (1999?).

* cited by examiner

*Primary Examiner*—Anita King
*Assistant Examiner*—Ingrid Weinhold
(74) *Attorney, Agent, or Firm*—Morris, Bateman, O'Bryant & Compagni

(57) ABSTRACT

A target clamp includes at least one plate, a biasing element disposed adjacent the plate, and an actuator adjacent the biasing element. When a target is disposed between the biasing element and the plate, the actuator can be moved from a first position to a second position to cause the biasing element to forcefully engage the target, thereby holding the target between the plate and the biasing element.

20 Claims, 5 Drawing Sheets

TARGET CLAMP

BACKGROUND OF THE INVENTION

1. Field of the Invention

The present invention relates to a clamp for holding targets used on shooting ranges and the like to an actuation mechanism which selectively displays the target. More particularly, the present invention relates to a clamp which more securely holds movable targets while facilitating placement and removal of the target in the clamp of the actuation mechanism.

2. State of the Art

It is common for law enforcement officers and others to engage in target practice to maintain their shooting accuracy. In conventional target practice, a target, i.e. an outline of a person, vehicle, etc., is held before a bullet trap (or other type of range). The trap receives bullets fired at the target and contains the bullet so that it may be retrieved and recycled. Such traps include total containment system wherein the bullet is received in a chamber, and less expensive berm traps in which the bullet is received by a bullet deceleration medium, such as sand or small rubber granules.

While target practice at set, stationary targets improves accuracy in that context, it fails to prepare the shooter for most real life situations. For example, a police officer shooting at a set target may obtain a high degree of accuracy in that scenario. However, the situation in which a police officer will be firing at a set target are rare. A more common scenario is for a criminal to suddenly appear from behind a door, wall, etc. If the officer is to avoid injury (or accidentally shooting an innocent person), it is critical for the officer to develop quick reflexes to enable immediate determination of whether the person poses a threat and accurate shooting if a threat is present.

One common training method for testing and improving reaction time is a turn and shoot target. The target is mounted to an actuation mechanism which selectively rotates the target between a first position, wherein the target is parallel with the line of fire and, thus, not exposed to the shooter, and a second position, wherein the target faces the shooter and is perpendicular with the line of fire. For added complexity, the actuation mechanism can be movable along a track so that the target moves toward and/or away from the shooter.

To test the officer's reaction time and accuracy, the actuation mechanism will suddenly turn the target from the first position, shown in FIG. 1A, to the second position, shown in FIG. 1B, to expose the target to the shooter. The officer must then quickly determine the threat posed by the target and fire if necessary. By viewing the target after completion of the exercise, the officer can determine his shooting accuracy under more realistic circumstances, as opposed to shooting a set target.

The target typically is formed from a sheet of paper or similar disposable material. Currently, it is common for the target to have two holes which are slid over bolts on the actuation mechanism. A pair of wing nuts are then used to engage the opposing side of the target. A close-up view of the attachment of the target to the actuation mechanism is shown in FIG. 1C.

One problem with the prior art configuration is that it takes time to remove and reattach the wing nuts. Another, more significant problem, is that if the target is turned too rapidly, the target has a tendency to tear. Sometimes, the target will tear free of the attachment and fall to the ground.

Other times, a portion of the target will tear causing the target to hang improperly.

In an attempt to resolve these concerns, attempts have been made to use biased spring clips, similar to those used to hold a number of documents together, to hold the target. A close-up view of a portion of an actuator having such attachment clips is shown in FIG. 1D. Such clips are advantageous in that they enable quick removal and replacement of the target. However, the force with which such clips hold the target is directly proportional to the pressure which must be applied to open the clips for insertion and removal of the target. Thus, the compression which can be used is limited by the ability of the user to open the clip without excessive effort. Thus, it is common for the clips either to be very difficult too open or to provide inadequate holding power to ensure that the target is not removed from the clamp of the actuation mechanism.

Thus, there is a need for an improved target clamp. Such a target clamp would securely hold the target to prevent tearing of the target during use. Such a target clamp would also allow rapid replacement of the target, while placing little strain on the user.

SUMMARY OF THE INVENTION

Thus, it is an object of the present invention to provide an improved target clamp and method of using the same.

It is another object of the present invention to provide such a target clamp which allows instant removal and replacement of a target.

It is yet another object of the present invention to provide a target clamp which securely holds a target and enables more rapid turning of the target without causing the target to detach from the clamp.

It is still yet another object of the present invention to provide a target clamp which requires little physical strength to use.

The above and other objects of the invention are realized in specific illustrated embodiments of a target clamp and method of use which includes a base of an actuation mechanism and a biasing element configured to engage a target when disposed in the base of the. actuation mechanism. Disposed adjacent to the biasing element is an actuator which causes the biasing element to selectively apply pressure to the target.

In accordance with one aspect of the invention, the base of the actuation mechanism is configured with a front plate and a rear plate configured to contain the biasing mechanism and target to hold the biasing mechanism is a compressed engagement with a portion of the target.

In accordance with one aspect of the invention, the biasing element is formed by a biasing spring which extends substantially the length of the base of the actuation mechanism to securely hold the target along the base of the actuation mechanism.

In accordance with another aspect of the invention, the actuator comprises an arm which is pivotable between a first position and second position to selectively engage the biasing element to selectively force the biasing element into firm engagement with the target.

In accordance with another aspect of the present invention, the arm forming the actuator is disposed to as to move generally perpendicular to the direction of force applied by the biasing element.

In accordance with still yet another aspect of the present invention, the biasing element is shaped such that the biasing element slides toward the a target in response to movement of the actuator arm from the first position to the second position.

BRIEF DESCRIPTION OF THE DRAWINGS

The above and other objects, features and advantages of the invention will become apparent from a consideration of the following detailed description presented in connection with the accompanying drawings in which.

DETAILED DESCRIPTION

Reference will now be made to the drawings in which the various elements of the present invention will be given numeral designations and in which the invention will be discussed so as to enable one skilled in the art to make and use the invention. It is to be understood that the following description is only exemplary of the principles of the present invention, and should not be viewed as narrowing the pending claims.

Figure 1A:
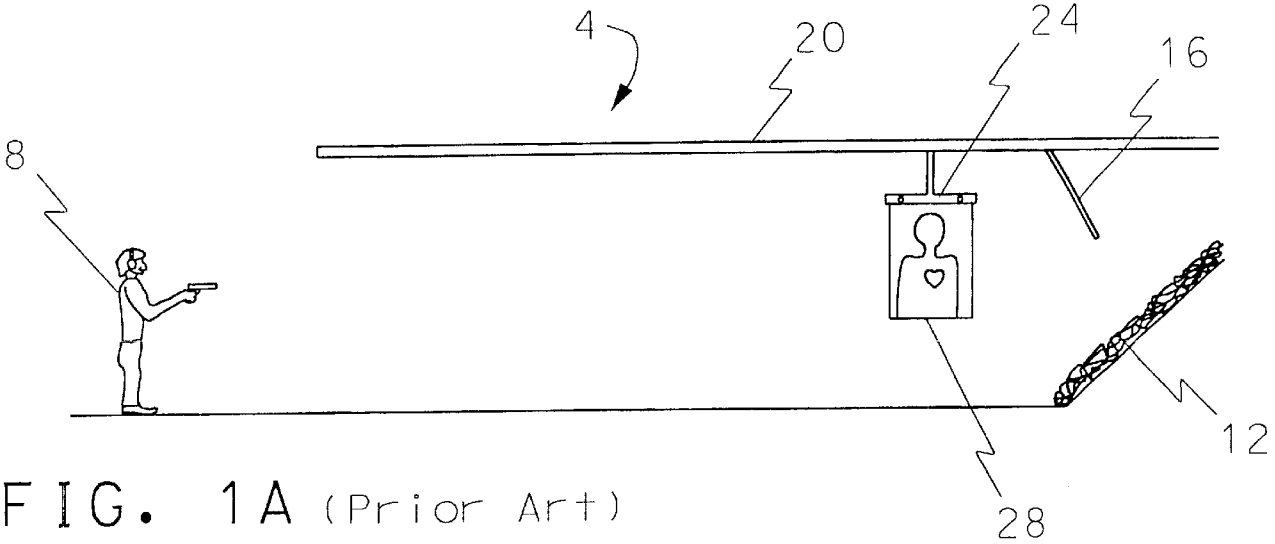
FIG. 1A (Prior Art)
FIG. 1A shows a shooting range in accordance with the teachings of the prior art, with the target disposed in a first position, parallel to the line of fire.

Turning to FIG. 1A there is shown a side view of a shooting range, generally indicated at 4, made in accordance with the prior art. A shooter 8, such as a police officer, stands at one end of the shooting range 4. Disposed at the opposing end is a bullet trap 12 formed by an inclined wall covered with bullet decelerating medium, such as rubber. A baffle 16 is disposed to deflect errant shots into the bullet trap 12.

Figure 1B:
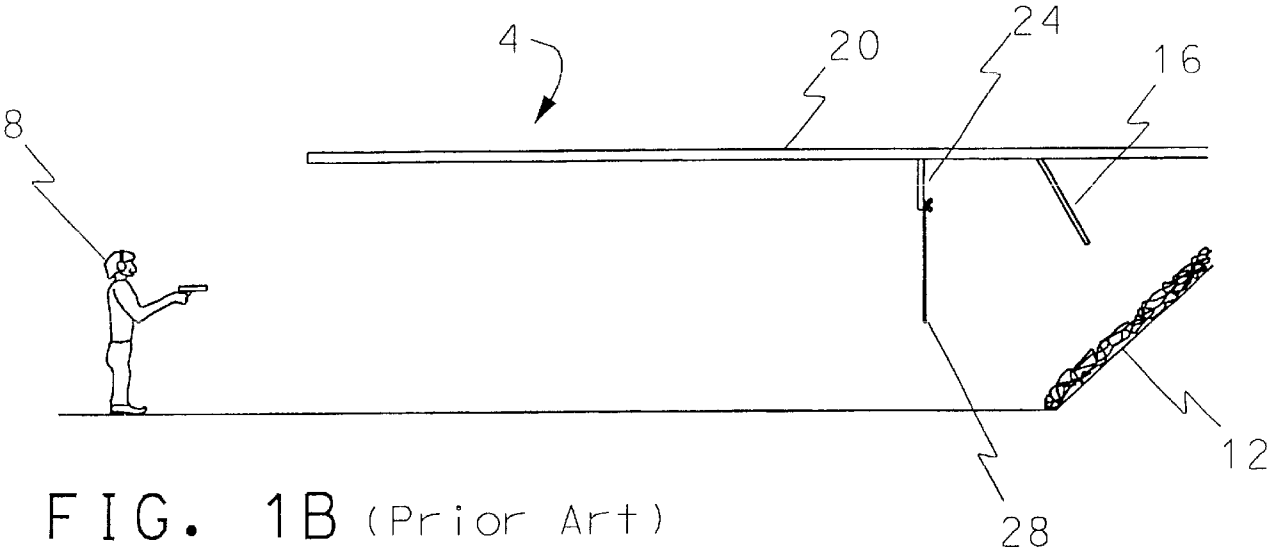
FIG. 1B (Prior Art)
FIG. 1B shows the shooting range of FIG. 1B with the target turned perpendicular to the line of fire.

Extending between the bullet trap 12 and the shooter 8 is a track 20 along which an actuation mechanism 24 is disposed. The actuation mechanism 24: holds a target 28. As shown in FIG. 1A, the target 28 is disposed parallel to the line of fire. In FIG. 1B, the actuation mechanism 24 has rotated the target 28 so that it is perpendicular to the line of fire and, thus, exposed to the shooter 8.

Figure 1C:
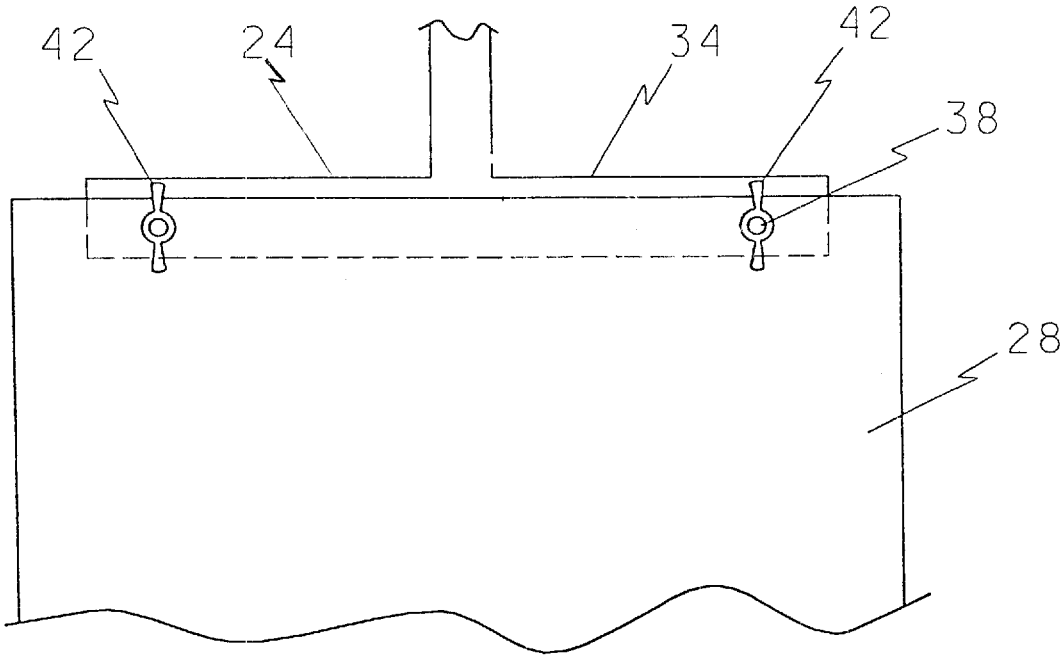
FIG. 1C (Prior Art)
FIG. 1C shows a close-up view of a prior art actuation mechanism and the means for attaching a target thereto.

In FIG. 1C, there is shown a close-up of the lower portion of the actuation mechanism 24. The actuation mechanism 24 includes a base 34 with a pair of bolts 38 extending therefrom. The top of target 28 has two holes for receiving the bolts 38. Wing-nuts 42 are then used to hold the target 28 on the bolts 38 of the base 34. However, when the actuation mechanism 24 is turned suddenly, the target 28 may tear adjacent to the bolts 38, causing the target to hang improperly or to fall.

Figure 1D:
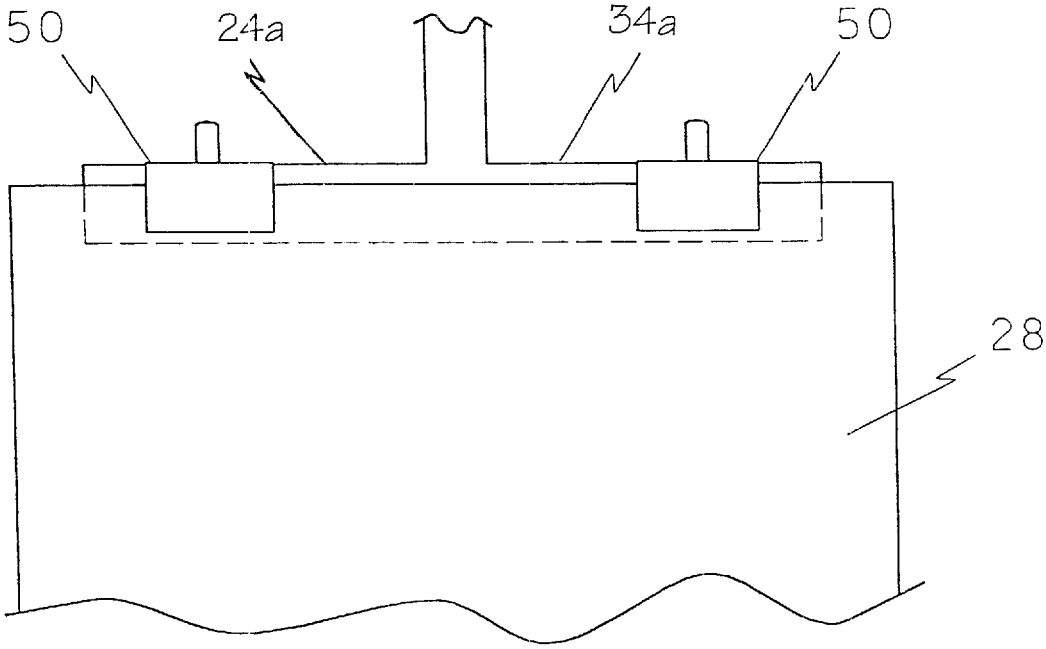
FIG. 1D (Prior Art)
FIG. 1D shows a close-up view of an alternate actuation mechanism of the prior art and the associated means for attaching a target thereto.

In FIG. 1D, there is shown a close-up view of the lower portion of an alternate embodiment of a prior art actuation mechanism 24*a*. The actuation mechanism 24*a* includes a base 34*a* for attachment to the target 28. Rather than using a bolt and wing-nut configuration, the embodiment of FIG. 1D utilizes a pair of spring clamps 50 similar to those used in place of paper clips. The configuration is advantageous over the configuration of FIG. 1C in that it allows for more rapid replacement of the target 28, and it does not require the target to have holes formed therein.

One significant drawback to the actuation mechanism 24*a* of FIG. 1D is that the amount of force required to open the spring clamps 50 is directly proportional to the amount of force the spring clamps 50 apply to the target 28. If the spring clamps 50 are configured to supply a significant amount of compression to the target 28, it can require considerable strength to open the spring clamps. Thus, there is an inherent trade-off between the ease of use and the ability of the spring clamps 50 to securely hold the target.

Figure 2B:
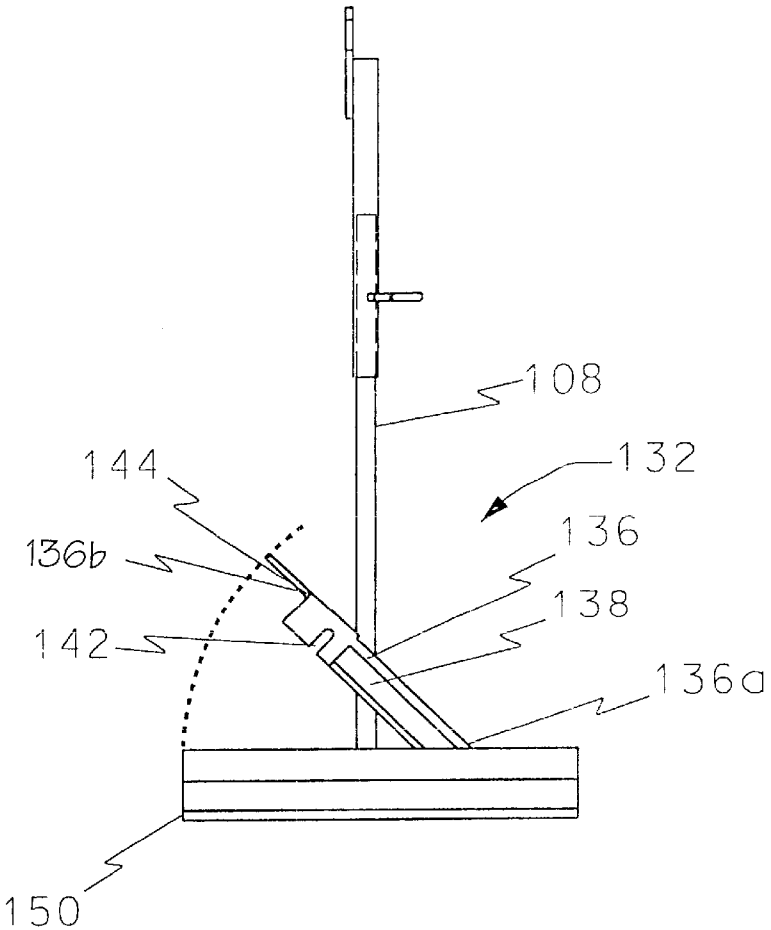
FIG. 2B shows a front view of the target clamp of FIG. 2A with the clamp in the open position.
Figure 2A:
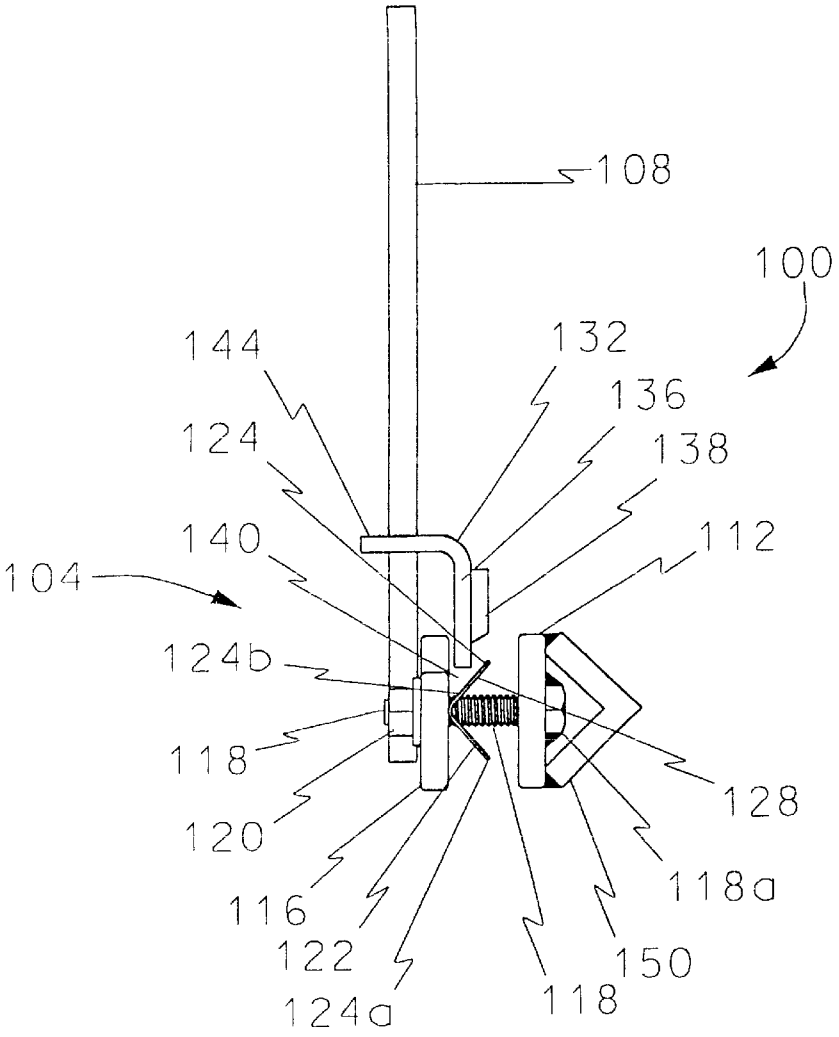
FIG. 2A shows a side view of a target clamp in accordance with the principles of the invention, with the clamp in an open position.

Turning now to FIG. 2A, there is shown a side view of a target clamp, generally indicated at 100, which resolves the concerns of the prior art. The target clamp 100 is formed at the base 104 of an actuation mechanism 108. Those skilled in the art will appreciate that the actuation mechanism 108 is typically mounted on a rail and is typically in communication with a motor which causes the actuation mechanism to rotate the target.

The base 104 of the actuation mechanism 108 preferably includes a front plate 112 and a back plate 116. The front plate 112 and the back plate 116 are held together by a pair of bolts 118, only one of which is visible in FIG. 2A. The bolts have a first end 118*a* anchoring the front plate 112, and a second end which receives a nut 120 for anchoring the rear plate 116. Preferably, the spacing between the front plate 112 and the back plate 116 is between 0.5 and 1.5 inches.

Disposed between the front plate 112 and the back plate 116 is a biasing element 122 in the form of a biasing spring 124. The biasing spring 124 preferably extends substantially the length of the front plate 112 and the back plate 116 and is formed by an elongate piece of metal or plastic 128 which has been formed to have a V-shaped cross-section, with the V being rotated 90 degrees. Those skilled in the art will appreciate that the biasing spring 124 could be made of materials other than metal or plastic and could have other cross-sectional shapes which provide a compressive force when pressure is applied thereto.

As shown in FIG. 2A, the biasing spring 124 receives a target between one end 124*a* of the V-shaped cross-section and the front plate 112 of the base 104 of the actuation mechanism 108. By simply reversing the biasing spring 124 and related components, the target could be held between the biasing spring and the rear plate 116.

Disposed adjacent to the biasing spring 124 in FIGS. 2A and 2B is an actuator, generally indicated at 132, in the form of an actuator arm 136. The actuator arm 136 is attached to the base portion 104 of the actuation mechanism 108 in such a manner that the actuator arm can selectively apply pressure to the biasing spring 124. To increase the displacement of the biasing spring 124, the a spacer 138 can be mounted on the arm 136. Preferably, the bottom of the spacer 138 is beveled to more smoothly engage the biasing spring 124.

Preferably, one end 136*a* of the actuator arm 136 is pivotably attached to the base 104 so that downward movement of the opposing end 136*b* of the actuator arm moves at least a portion of the actuator arm down into the void 140 between the front plate 112 and the back plate 116. A channel 142 is formed in the arm 136 so that the bolt 118 does not interfere with its advancement and a handle 144 is formed on the actuator arm for ease of pivoting the arm up and down.

As the actuator arm 136 and the spacer 138 move into the void 140 between the front plate 112 and the rear plate 114, the actuator arm 136 and spacer 138 engages the back side 124*b* of the biasing spring 124. As the actuator arm 136 and spacer 138 continue to move into the void 140, they increasingly displace the biasing spring toward the front plate 112 until the back of the biasing spring 124 contacts a flat or concave surface which will not urge the actuator arm 136 upwardly in response to the compressed biasing spring. This sustained compression of the biasing spring 124 causes the biasing spring to flex open and apply a compressive force against the front plate 112 as discussed below.

Also shown in FIGS. 2A and 2B is a angled front impact plate 150. The angled front impact plate 150 is formed from is a generally V-shaped piece of metal. The angled front impact plate is configured to deflect bullets away from the bolt 118 and front plate 116 to thereby prevent damage to the target clamp 100.

Figure 3B:
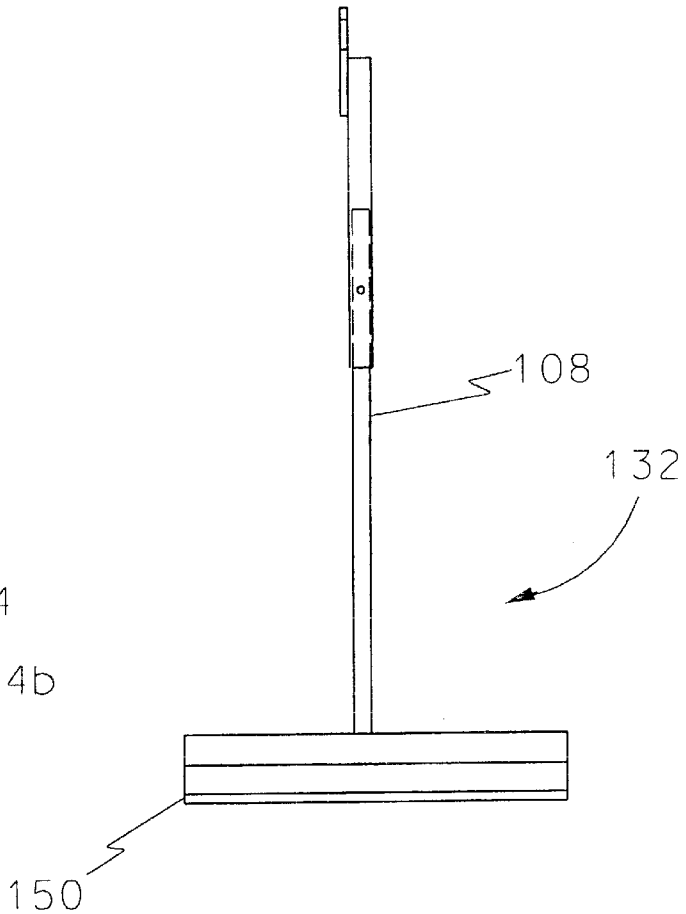
FIG. 3B shows a front view of the target clamp of FIGS. 2A through 3A with the clamp in a closed position.
Figure 3A:
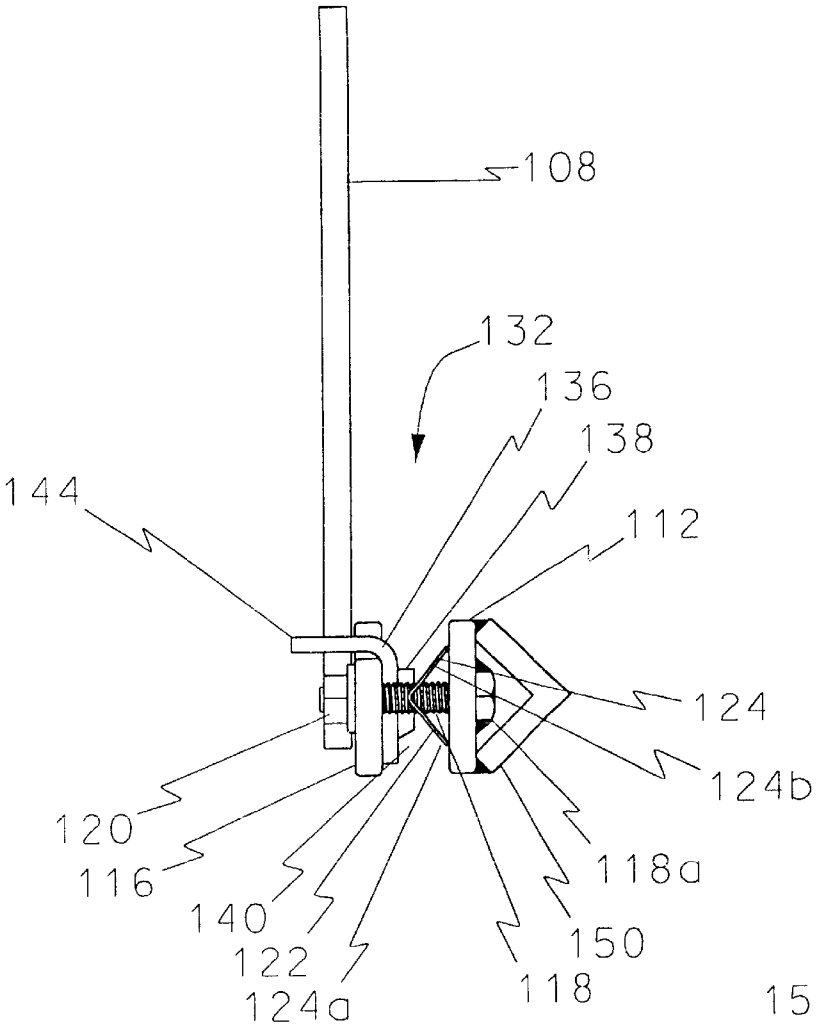
FIG. 3A shows a side view of the target clamp of FIGS. 2A and 2B with the target clamp being disposed in a closed position.
Figure 3C:
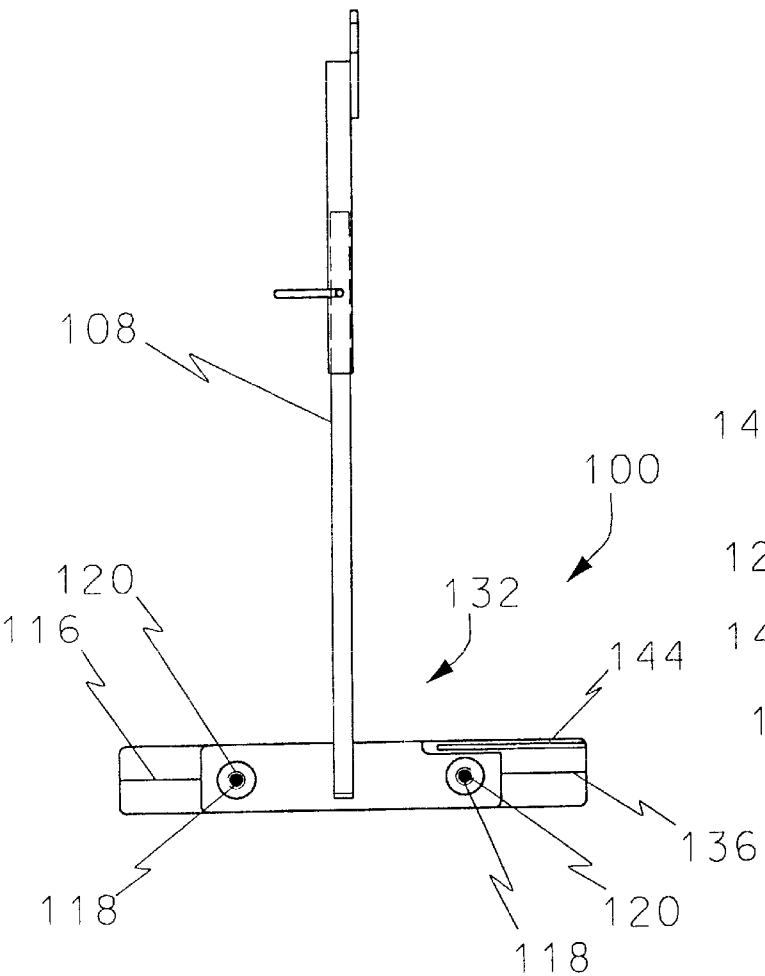
FIG. 3C shows a rear view of the target clamp of FIGS. 2A through 3B with the clamp in a closed position.

Turning now to FIGS. 3A, 3B and 3C, there is shown, respectively a side view, a front view, and a rear view of the target clamp of FIGS. 2A and 2B with the target clamp 100 being disposed in a closed position.

As the actuator arm 136 and spacer 138 are moved into the void 140 between the front plate 112 and rear plate 116, it engages the back side 124*b* of the biasing spring 124 and forces the end 124*a* of the biasing spring to engage the front plate 112, or a target disposed between the biasing spring and the front plate.

With the actuator arm 136 in the closed position, the bottom portion of the actuation mechanism 108 has a profile which is substantially the same as that of the prior art. By simply applying an upward force on the handle 144 of the actuator arm 136, however, allows the arm to be removed from the void 140. This allows movement of the biasing spring 124 and insertion and removal of the target. While the prior art configuration shown in FIG. 1D had a tendency to either not hold the target securely or to be too difficult to open, the actuator arm 136 can be moved up and down easily. The cam effect of the arm 136 and the biasing spring 124, however, applies considerable force to the target.

Figure 4:
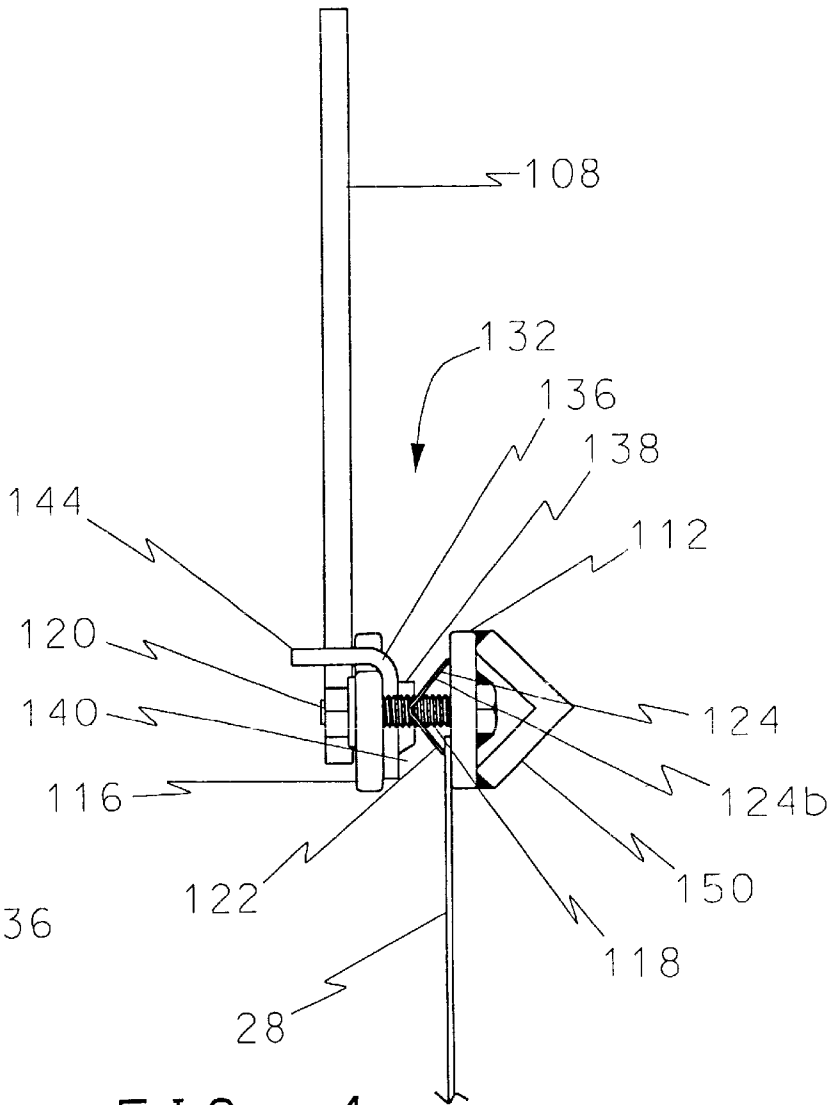
FIG. 4 shows a side view of the target clamp of FIGS. 2A through 3B with a target disposed in the clamp.

Finally, FIG. 4 shows a side view of the target clamp 100 with a target 28 mounted therein. The components of the target clamp 100 are the same as those discussed above and are numbered accordingly.

When the actuator arm 136 is in the open or up position, the biasing spring 124 is able to move along the bolt 118 away from the front plate 112. This allows the target to be advanced between the bottom half of the biasing spring 124 and the front plate 112 until the target 28 contacts the bolt 118. Once the target is in place, the actuator arm 136 is pulled down, causing the biasing spring 124 to move forward and forcefully engage the target with its bottom leg. (Of course, the target could have channel formed in the top to allow the target to extend above the bolts 118).

With the arm 136 in the void 140, the biasing spring 124 applies a compressive force against the target. The compressive force secures the target 28 between the end 124*a* of the biasing spring 124 and the front plate 112 so that the target is much less likely to tear or otherwise be pulled from the target clamp. The target 28 remains securely between the end of the spring 124*a* and the front plate 112 even if the actuation mechanism 108 is rotated suddenly.

Once the shooter has finished with the target, the actuator arm 136 is lifted upwardly, releasing the biasing spring 124. This allows the target 28 to be pulled from the target clamp 100 and a new target to be inserted. Because the actuator arm 136 moves orthogonally to the direction of movement of the biasing spring 124, procedure of replacing the target is generally easier than with the prior art devices and provides an improved hold on the target.

Thus there is disclosed an improved target clamp and method of use. Those skilled in the art will appreciate numerous modifications which can be made without departing from the scope and spirit of the present invention. The appended claims are intended to cover such modifications.

What is claimed is:

1. A target clamp comprising:

a plate;

a biasing element disposed adjacent to the plate and configured for movement toward the plate for holding a target between the biasing element and the plate; and an actuator disposed in communication with the biasing element, and configured for selectively forcing the biasing element toward the plate so as to hold a target therebetween.

2. The target clamp of claim 1, wherein the biasing element comprising a biasing spring formed of an elongate piece of material.

3. The target clamp of claim 1, wherein the biasing spring has a V-shaped cross-section.

4. The target clamp of claim 1, wherein the actuator comprises an arm pivotable between a first, open position wherein the arm does not force the biasing element toward the plate, and a second, closed position, wherein the actuator forces the biasing element toward the plate.

5. The target clamp of claim 1, wherein the actuator further comprises a spacer disposed on the arm for increasing displacement of the biasing element toward the plate.

6. The target clamp of claim 1, wherein the plate is a front plate, and wherein the target clamp further comprises a back plate, the front plate and the back plate being spaced apart to create a void, and the biasing element being disposed in the void.

7. The target clamp of claim 1, wherein the biasing element moves in a first plane within the void to apply a compressive force to the target, and wherein the actuator moves in a plane orthogonal to the first plane.

8. The target clamp of claim 1, further comprising a front impact plate.

9. A target clamp comprising:.

a plate;

a biasing element disposed adjacent to the plate and configured for movement toward the plate for holding a target between the biasing element and the plate;

an actuator disposed in communication with the biasing element, and configured for selectively forcing the biasing element toward the plate so as to hold a target therebetween; and wherein the plate is a front plate, and wherein the target clamp further comprises a back plate spaced apart from the front plate by a pair of bolts, and wherein the biasing element is disposed between the front plate and back plate and is slidable along said bolts.

10. The target clamp of claim 1, wherein the actuator moves vertically from an upper position to a lower position to move the biasing spring, and wherein the biasing spring moves horizontally responsive to the vertical movement of the actuator.

11. A target clamp disposed on an actuation mechanism, the target clamp comprising:

a means for holding a target, said means comprising a biasing means configured for engaging one side of the target and a means for engaging an opposing side of the target; and an actuator disposed in communication with the biasing means and movable between a first position wherein the biasing means does not forcefully engage a target positioned between the biasing means and the means for engaging an opposing side of the target, and a second position, wherein the actuator forces the biasing means toward the means for engaging a opposing side of the target to hold the target therebetween.

12. An actuation mechanism for holding a target comprising:

a target clamp having:

a front plate and a rear plate, the front plate and rear plate being spaced apart to receive a target;

a biasing element disposed between the front plate and the rear plate; and an actuator disposed in communication with the biasing element for applying a force to the biasing element to thereby cause the biasing element to forcefully engage a target disposed between the front plate and the rear plate.

13. The actuation mechanism of claim 12, wherein the actuator and biasing element form a cam.

14. The actuation mechanism of claim 12, wherein the actuator is movable between a first position wherein the actuator does not force the biasing element to forcefully engage a target disposed between the front plate and rear plate, and a second position, wherein the actuator forces the biasing element to forcefully engage a target disposed between the front plate and the rear plate.

15. The actuation mechanism of claim 14, wherein the actuator is disposed at least partially between the front plate and the rear plate when in the second position.

16. The actuation mechanism of claim 14, wherein the actuator comprises an arm pivotable with respect to the biasing element, and configured for engaging the biasing element.

17. The actuation mechanism of claim 16, wherein the front plate and rear plate are held together by at least one fastener, and wherein the arm is pivotably mounted so as to be rotatable into a space between the front plate and the rear plate.

18. The actuation mechanism of claim 17, wherein the biasing element is slidable among said fastener.

19. The actuation mechanism of claim 12, wherein the biasing element comprises a biasing spring formed by an elongate piece of material having a generally V-shaped cross-section.

20. The actuation mechanism of claim 12, wherein the biasing element moves in a first plane, and wherein the actuator moves in a second plane perpendicular to the first plane.

* * * * *